US009212844B2

(12) United States Patent
Lee et al.

(10) Patent No.: US 9,212,844 B2
(45) Date of Patent: Dec. 15, 2015

(54) DRAIN HOSE ASSEMBLY AND REFRIGERATOR INCLUDING THE SAME

(75) Inventors: Hyun Nam Lee, Gwangju (KR); Sang Soo Kim, Gwangju (KR); Sang Gyu Jung, Gwangju-si (KR); Mu Yeol Sun, Gwangju-si (KR); Sang Hyeok Park, Busan (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 442 days.

(21) Appl. No.: 13/350,257

(22) Filed: Jan. 13, 2012

(65) Prior Publication Data

US 2012/0180514 A1 Jul. 19, 2012

(30) Foreign Application Priority Data

Jan. 17, 2011 (KR) ..... 10-2011-0004385

(51) Int. Cl.
*F25D 21/14* (2006.01)

(52) U.S. Cl.
CPC ..... *F25D 21/14* (2013.01); *F25D 2321/146* (2013.01)

(58) Field of Classification Search
CPC ..... F25D 21/10; F25D 2321/143; F25D 2321/146; F25D 2321/1441; F25D 2321/142
USPC ..... 62/279, 285, 291, 289, 280
See application file for complete search history.

(56) References Cited

U.S. PATENT DOCUMENTS

| | | | | |
|---|---|---|---|---|
| 4,843,835 | A * | 7/1989 | Goetz et al. | 62/285 |
| 5,499,514 | A | 3/1996 | Ho | |
| 2006/0277934 | A1 * | 12/2006 | Cho | 62/285 |
| 2010/0269531 | A1 * | 10/2010 | Samdan et al. | 62/285 |

FOREIGN PATENT DOCUMENTS

| | | | | |
|---|---|---|---|---|
| EP | 1731860 | | 12/2006 | |
| KR | 0122993 | | 5/1998 | |
| KR | 10-0214621 | | 8/1999 | |
| KR | 100274502 | B1 * | 12/2000 | |
| WO | WO 2008056602 | A1 * | 5/2008 | F24F 13/22 |
| WO | 2009/132940 | | 11/2009 | |

OTHER PUBLICATIONS

Extended European Search Report issued Dec. 10, 2013 in European Patent Application No. 12150855.0.

* cited by examiner

*Primary Examiner* — Cheryl J Tyler
*Assistant Examiner* — Elizabeth Martin
(74) *Attorney, Agent, or Firm* — Staas & Halsey LLP

(57) ABSTRACT

A refrigerator may include a drain hose assembly. The refrigerator includes an upper hose, a lower hose connected to the upper hose while being arranged in a machinery chamber, the lower hose being provided with an air inlet hole to introduce outside air, and an opening and closing unit provided at the lower hose to be upwardly pivoted by negative pressure in a storage chamber and to be downwardly pivoted by gravity, in order to open and close the air inlet hole, respectively. As a result, it may be possible to achieve an enhancement in energy efficiency and to reduce the force required to open door according to an improvement of sealing-tightness.

19 Claims, 9 Drawing Sheets

DRAIN HOSE ASSEMBLY AND REFRIGERATOR INCLUDING THE SAME

CROSS-REFERENCE TO RELATED APPLICATIONS

This application claims the priority benefit of Korean Patent Application No. 10-2011-0004385 filed on Jan. 17, 2011 in the Korean Intellectual Property Office, the disclosure of which is incorporated herein by reference in its entirety.

BACKGROUND

1. Field

Embodiments of the present invention relate to a refrigerator including a drain hose assembly to discharge defrost water.

2. Description of the Related Art

In general, refrigerators are used to store food in a fresh state at a low temperature by supplying cold air to a storage chamber for food. Such a refrigerator includes a freezing chamber maintained at or below freezing temperature and a refrigerating chamber maintained at a temperature slightly higher than freezing temperature.

Cold air in the refrigerator is created by heat exchange of refrigerant while being repeatedly subjected to a refrigeration cycle through a compression-condensation-expansion-evaporation process. During the process of the refrigeration cycle, the cold air is continuously supplied to the inside of the refrigerator, and the supplied cold air is evenly circulated in the refrigerator through convection. Consequently, food in the refrigerator may be stored at a desired temperature.

Meanwhile, heat exchange of the refrigerant with ambient air is performed in an evaporator during the process of the refrigeration cycle. In this case, frost is generated on a surface of the evaporator due to a temperature difference between the evaporator and an ambient area thereof. Therefore, a defrost operation for removal of the frost should be performed in the refrigerator.

Defrost water, which is generated during the defrost operation, is collected through a drain hose into an evaporation tray mounted in a machinery chamber, and is then evaporated.

Such a drain hose allows outside air to be introduced into the storage chamber from the machinery chamber. Accordingly, it may be considerably important that the drain hose has a sealing structure to prevent this outside air from being introduced.

SUMMARY

Therefore, it is an aspect of the present invention to provide a drain hose assembly having an improved sealing structure, and a refrigerator including the drain hose assembly.

Additional aspects of the invention will be set forth in part in the description which follows and, in part, will be obvious from the description, or may be learned by practice of the invention.

In accordance with one aspect of the present invention, a refrigerator includes a main body to define a storage chamber, a door mounted at the main body to open and close the storage chamber, an evaporator to cool the storage chamber, an inner case to define the storage chamber, the inner case including an evaporator receiving portion at which the evaporator is installed and a defrost water tray slantingly arranged at a lower side of the evaporator receiving portion, a machinery chamber provided at a lower portion of the main body to receive an evaporation tray, an upper hose communicated with the defrost water tray, a lower hose connected to the upper hose while extending to the evaporation tray, the lower hose being provided, at one side thereof, with an air inlet hole to introduce outside air, a lower cap coupled to a lower end of the lower hose while having an elastic cover to prevent air from being introduced into the lower hose, and an opening and closing unit provided at the lower hose to open the air inlet hole by an internal pressure of the storage chamber during opening of the door, and to close the air inlet hole by gravity.

The air inlet hole may be formed at a slanted mounting surface arranged to protrude toward an inside of the lower hose while being slanted downward. The opening and closing unit may include a barrier plate hinged to the slanted mounting surface.

The barrier plate may be made of an elastic material.

The refrigerator may further include a fastener to fasten the upper hose and the lower hose through spiral rotation of the fastener. When being fastened by the fastener, the upper and lower hoses may be coupled in a press-fitted manner.

The fastener may include a coupling protrusion protruding from an outer peripheral surface of the upper hose, and a coupling groove formed at an inner peripheral surface of the lower hose so as to be coupled to the coupling protrusion. The coupling groove may include an entry portion into which the coupling protrusion is inserted, a spiral portion arranged beneath the entry portion to guide the coupling protrusion in upward and downward directions, and a latch arranged at a lower end of the spiral portion to prevent separation of the coupling protrusion.

A tapered portion, into which an end of the upper hose is press-fitted, may be provided beneath the coupling groove.

The lower cap may include a body, which is made of an elastic material and has a cylindrical shape, press-fitted into the lower hose. The elastic cover may be integrally formed with the body through a slit cut along an outer peripheral portion of the body to close a lower opening of the lower hose.

The slit may be formed to be slanted upward as going from a hinge portion for connection of the elastic cover and the body in an opposite direction of the hinge portion.

The lower cap may further include a sealing protrusion formed to protrude along an inner peripheral surface of the body.

The lower cap may further include an elastic rib formed to connect the body, hinge portion, and elastic cover, in order to provide elastic force to upwardly press the elastic cover.

The opening and closing unit may include an inner housing coupled to the air inlet hole, an outer housing coupled to the inner housing while having the air inlet hole to be communicated with an inside of the lower hose, and a barrier plate interposed between the inner and outer housings to open and close the air inlet hole.

The outer housing may further have a slanted mounting surface having a hinge protrusion which protrudes from a back surface of the outer housing to the inside of the lower hose, wherein the barrier plate is pivotally coupled to the hinge protrusion.

The barrier plate may include a barrier plate hinge portion coupled to the hinge protrusion, and a shielding portion formed to extend from the barrier plate hinge portion to open and close the air inlet hole.

In accordance with another aspect of the present invention, a refrigerator includes a drain hose assembly including a storage chamber, a door to open and close the storage chamber, and an evaporator installed at a rear side of the storage chamber, so as to discharge defrost water generated on the evaporator. The drain hose assembly may include an upper hose and a lower hose coupled to each other, a lower cap coupled to a lower end of the lower hose to discharge defrost water, an air inlet hole provided at one side of the lower hose to introduce outside air, and an opening and closing unit to be upwardly pivoted by an internal pressure of the storage chamber during opening of the door in order to open the air inlet hole, and to be downwardly pivoted by gravity in order to close the air inlet hole.

The air inlet hole may be formed at a slanted mounting surface arranged to protrude toward an inside of the lower hose while being slanted downward. The opening and closing unit may include a barrier plate, which is made of an elastic material, hinged to the slanted mounting surface.

The drain hose assembly may further include a fastener to fasten the upper hose and the lower hose through spiral rotation of the fastener, wherein when the upper and lower hoses may be coupled by the fastener, an outer peripheral surface of the upper hose may be press-fitted to an inner peripheral surface of the lower hose so that contact surfaces of the upper and lower hoses are sealed.

Each of the contact surfaces of the upper and lower hoses may have a tapered shape having a diameter reduced as going downward.

The fastener may include a coupling protrusion protruding from the outer peripheral surface of the upper hose, and a coupling groove formed at the inner peripheral surface of the lower hose so as to allow the coupling protrusion to be inserted into the coupling groove. The coupling groove may include an entry portion into which the coupling protrusion is inserted, a spiral portion to guide the coupling protrusion in upward and downward directions, and a latch formed at a lower end of the spiral portion to prevent separation of the coupling protrusion.

The lower cap may include an elastic cover to close a lower opening of the lower hose by elasticity and to open the lower opening of the lower hose by being downwardly pivoted by a weight of defrost water.

The lower cap may include a body, which is made of an elastic material, press-fitted into the lower end of the lower hose. The elastic cover may be integrally formed with the body through a slit cut along an outer peripheral portion of the body.

The slit may be provided, at one side thereof, with a hinge portion connected to the body. The elastic cover may close the lower opening of the lower hose by elasticity of the hinge portion.

The lower cap may further include an elastic rib to connect the body, the hinge portion, and a base surface of the elastic cover, in order to increase elastic force of the hinge portion.

In accordance with another aspect of the present invention, a refrigerator may include a drain hose assembly to discharge defrost water generated on an evaporator installed at a rear side of a storage chamber to an evaporation tray mounted in a machinery chamber provided beneath the storage chamber, wherein the drain hose assembly includes an upper hose, and a lower hose coupled to the upper hose while being arranged in the machinery chamber, where the lower hose is provided with an air inlet hole to introduce outside air, and the air inlet hole is provided with an opening and closing unit to be upwardly pivoted by a negative pressure in the storage chamber and to be downwardly pivoted by gravity, in order to open and close the air inlet hole, respectively.

The air inlet hole may be formed at a slanted mounting surface arranged to protrude toward an inside of the lower hose while being slanted downward. The opening and closing unit may include a barrier plate, which may be made of an elastic material, including a barrier plate hinge portion hinged to a slanted mounting surface and a shielding portion extending from the barrier plate hinge portion to close the air inlet hole, wherein the barrier plate hinge portion and the shielding portion may be integrally formed.

In accordance with another aspect of the present invention, a refrigerator may include a drain hose assembly to discharge defrost water generated on an evaporator installed at a rear side of a storage chamber, wherein the drain hose assembly includes an upper hose and a lower hose coupled to each other, a lower cap coupled to a lower end of the lower hose to close a lower opening of the lower hose and to be pivoted by a weight of defrost water so as to discharge defrost water, an air inlet hole provided at one side of the lower hose to introduce outside air, and an opening and closing unit to be upwardly pivoted by a negative pressure in the storage chamber to open the air inlet hole, and to be downwardly pivoted by gravity to close the air inlet hole. The upper and lower hoses may have contact surfaces so as to be press-fitted to each other, respectively, wherein each of the contact surfaces may be comprised of a tapered shape having a diameter reduced as going downward.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
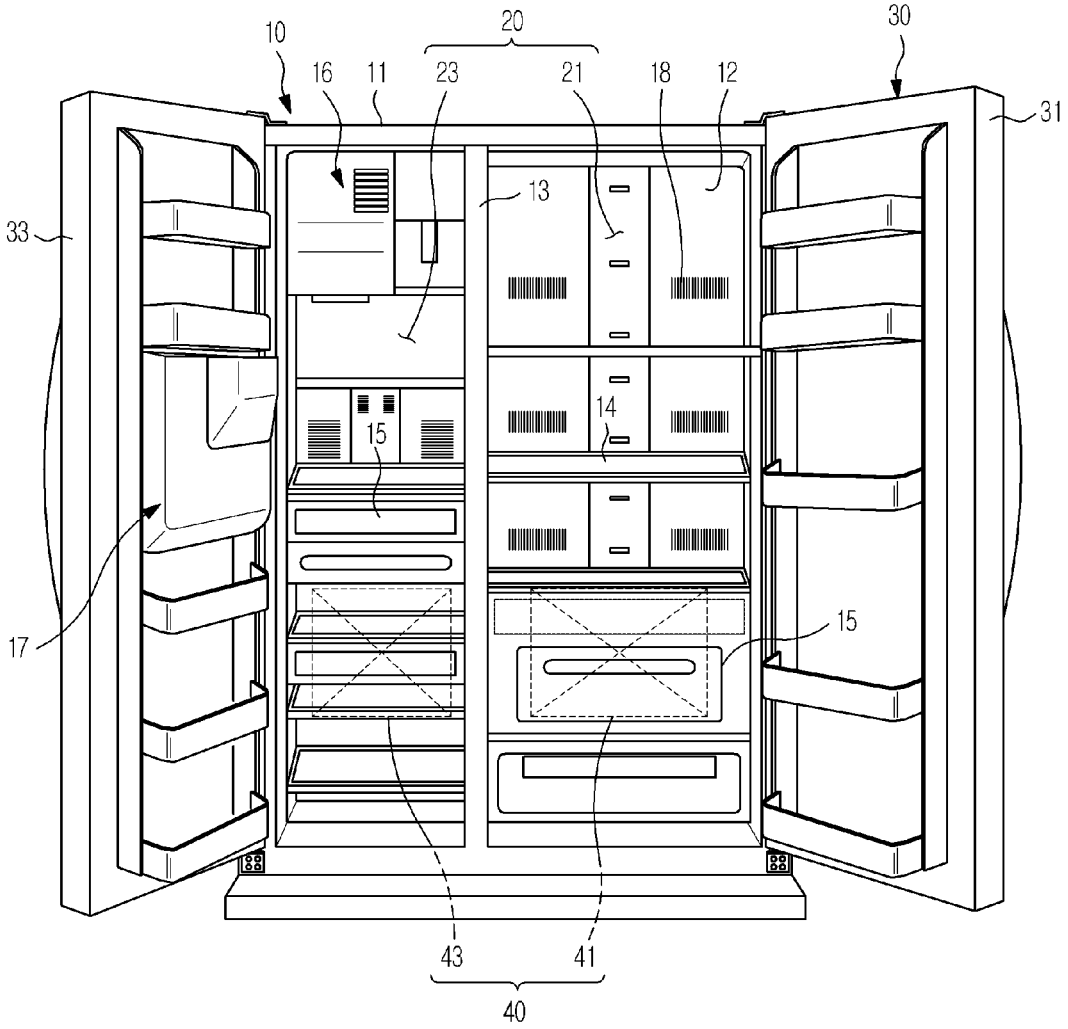
FIG. 1 is a perspective view illustrating a state in which a door of a refrigerator according to an exemplary embodiment of the present invention is opened.

Reference will now be made in detail to the embodiments of the present invention, examples of which are illustrated in the accompanying drawings, wherein like reference numerals refer to like elements throughout.

FIG. 1 is a perspective view illustrating a state in which a door of a refrigerator according to an exemplary embodiment of the present invention is opened.

As shown in FIG. 1, the refrigerator may include a main body 10 defining an external appearance thereof and forming a storage chamber 20 therein, and a door 30 pivotally mounted at the main body 10 to open and close the storage chamber 20.

The main body 10 may include an outer case 11 defining an external appearance thereof, an inner case 12 spaced apart from the outer case 11 by a predetermined clearance to define the interior of the storage chamber 20, and an insulating material 13*a* (see FIG. 2) foamed between the outer and inner cases 11 and 12.

The storage chamber 20 may include a refrigerating chamber 21 and a freezing chamber 23 which are divided by a vertical partition wall 13. The door 30 may include a refrigerating chamber door 31 and a freezing chamber door 33 to open and close the refrigerating and freezing chambers 21 and 23, respectively. The refrigerating and freezing chamber doors 31 and 33 may be equipped with flexible gaskets (not shown) to maintain sealing-tightness of the storage chamber 20, respectively.

The storage chamber 20 may be provided, at an upper portion thereof, with a plurality of trays 14 on which food is placed while being provided, at a lower portion thereof, with an extractable storage box 15 to store food.

An ice maker 16 to make ice cubes may be mounted at one side of an upper portion of the freezing chamber 23. The freezing chamber door 33 may be equipped with a dispenser 17 from which ice cubes made in the ice maker 16 are extracted.

An evaporator 40, which creates cold air to cool the storage chamber 20, may be installed at a rear side of the storage chamber 20. The evaporator 40 may include a refrigerating chamber evaporator 41 and a freezing chamber evaporator 43. The refrigerating chamber evaporator 41 creates cold air to cool the refrigerating chamber 21, whereas the freezing chamber evaporator 43 creates cold air to cool the freezing chamber 23.

The cold air created in the evaporator 40 is discharged to the storage chamber 20 through each cold air outlet hole 18 formed at the rear side of the storage chamber 20.

Figure 2:
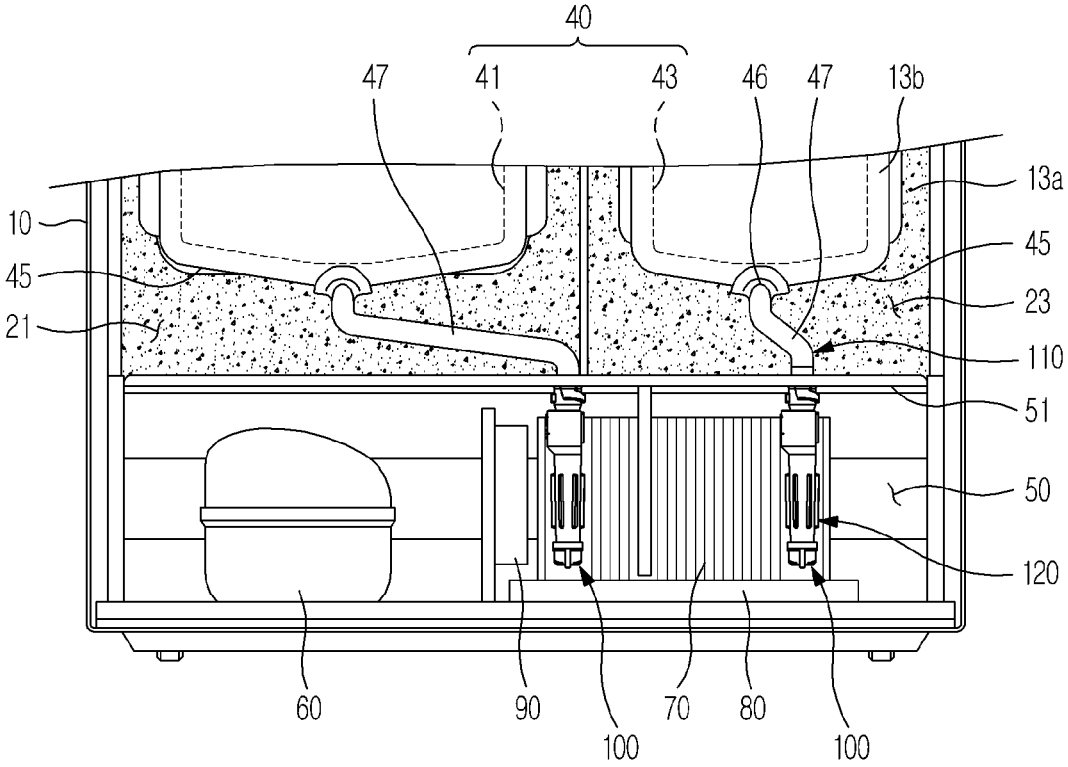
FIG. 2 is a sectional view illustrating a structure of a machinery chamber in the refrigerator according to an exemplary embodiment of the present invention.

FIG. 2 is a sectional view illustrating a structure of a machinery chamber in the refrigerator according to an exemplary embodiment of the present invention.

As shown in FIG. 2, the main body 10 may be provided, at a lower portion thereof, with a machinery chamber 50 in which a compressor 60 and a condenser 70 forming a refrigeration cycle are installed. The machinery chamber 50 may be arranged at a lower rear side of the storage chamber 20. An evaporation tray 80 may be mounted in the machinery chamber 50 to collect defrost water produced as frost generated on the evaporator 40 thaws.

The refrigerating and freezing chamber evaporators 41 and 43 of the evaporator 40 may be installed at evaporator receiving portions 13*b* formed to be recessed from the inner case 12, respectively. Each evaporator receiving portion 13*b* may be provided, at a lower side thereof, with a defrost water tray 45 to collect defrost water which is generated during a defrost operation for removal of frost generated on the evaporator 40, namely, the corresponding refrigerating or freezing chamber evaporator 41 or 43.

The defrost water collected in each defrost water tray 45 is discharged to the evaporation tray 80 mounted in the machinery chamber 50 through a corresponding drain hose assembly 100 installed at the rear side of the storage chamber 20. The defrost water tray 45 may be a substantially funnel shape to be slantingly arranged at a lower side of the corresponding evaporator receiving portion 13*b* at which the corresponding refrigerating or freezing chamber evaporator 41 or 43 is installed.

Each drain hose assembly 100 may include an upper hose 110 and a lower hose 120.

One end of the upper hose 110 may be communicated with a drain outlet 46 of the corresponding defrost water tray 45, whereas the other end of the upper hose 110 may be connected to a base plate 51 which defines the machinery chamber 50. Also, an intermediate area of the upper hose 110 may be a connection portion 47 which may be enclosed by the insulating material 13*a*. Further, the other end of the upper hose 110 may be coupled to the corresponding lower hose 120 disposed in the machinery chamber 50.

In accordance with such a configuration, the defrost water collected in each defrost water tray 45 is discharged to the evaporation tray 80 through the drain hose assembly 100 including the corresponding upper and lower hoses 110 and 120. Subsequently, the defrost water collected in the evaporation tray 80 is evaporated by air movement from the blowing force of a fan 90 and heat generated from the condenser 70.

The drain hose assembly 100 may cause a space in which the evaporator 40 is installed and the machinery chamber 50 to be communicated with each other. To this end, the drain hose assembly 100 has a sealing structure to prevent high-temperature and high-humidity air generated in the machinery chamber 50 from being introduced toward the evaporator 40.

Figure 3:
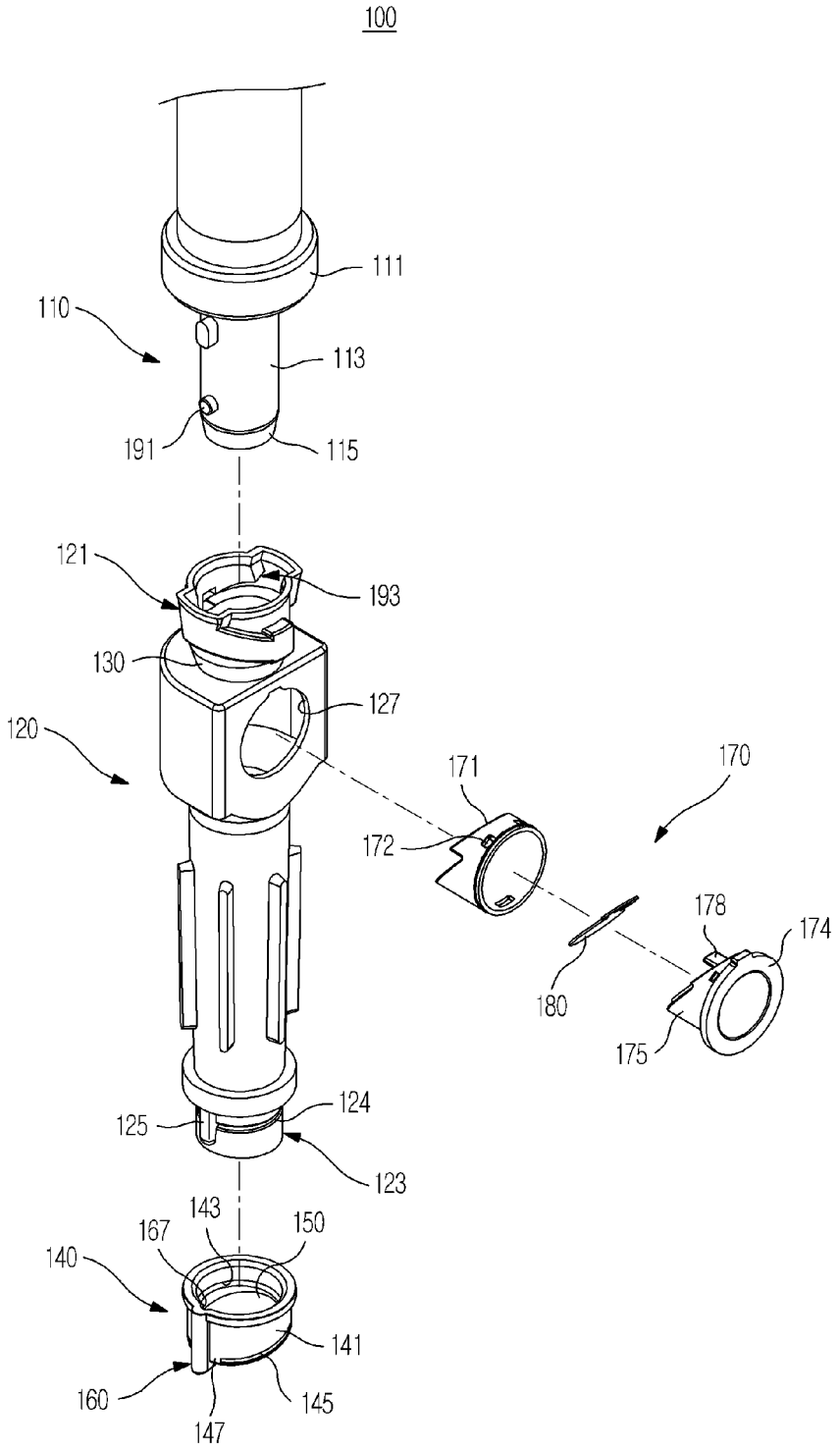
FIG. 3 is an exploded perspective view illustrating one drain hose assembly according to an exemplary embodiment of the present invention.
Figure 4:
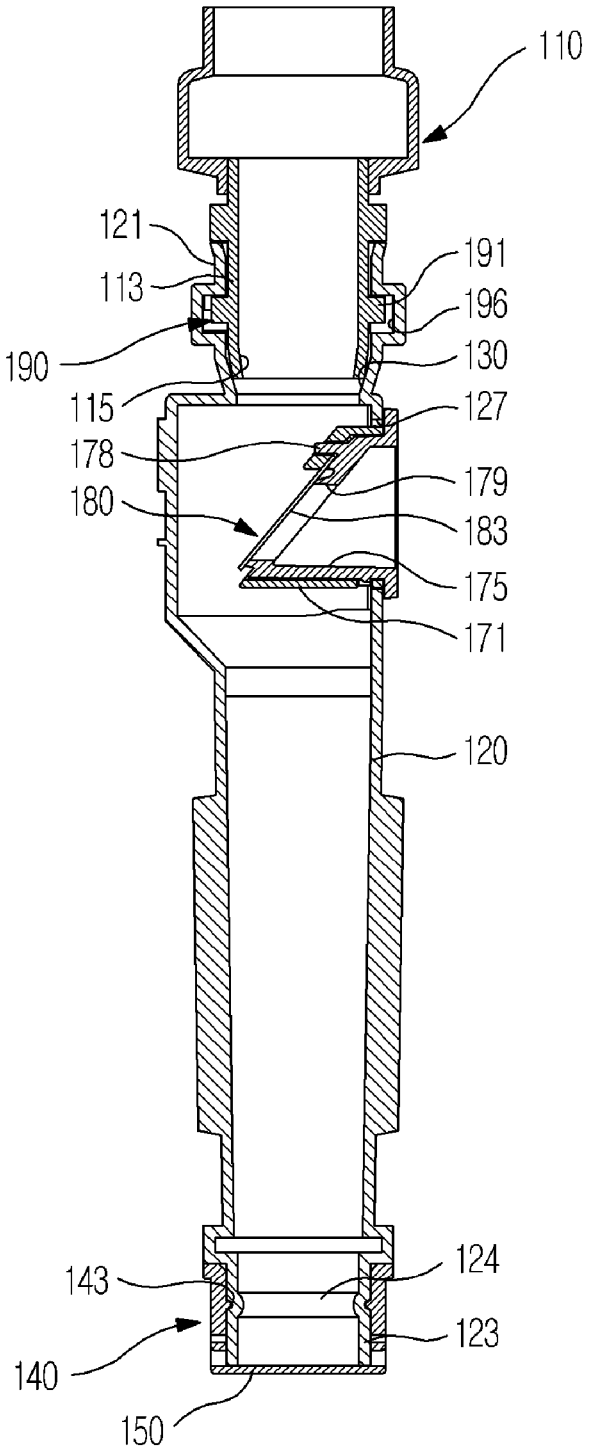
FIG. 4 is a coupled sectional view corresponding to FIG. 3.
Figure 5:
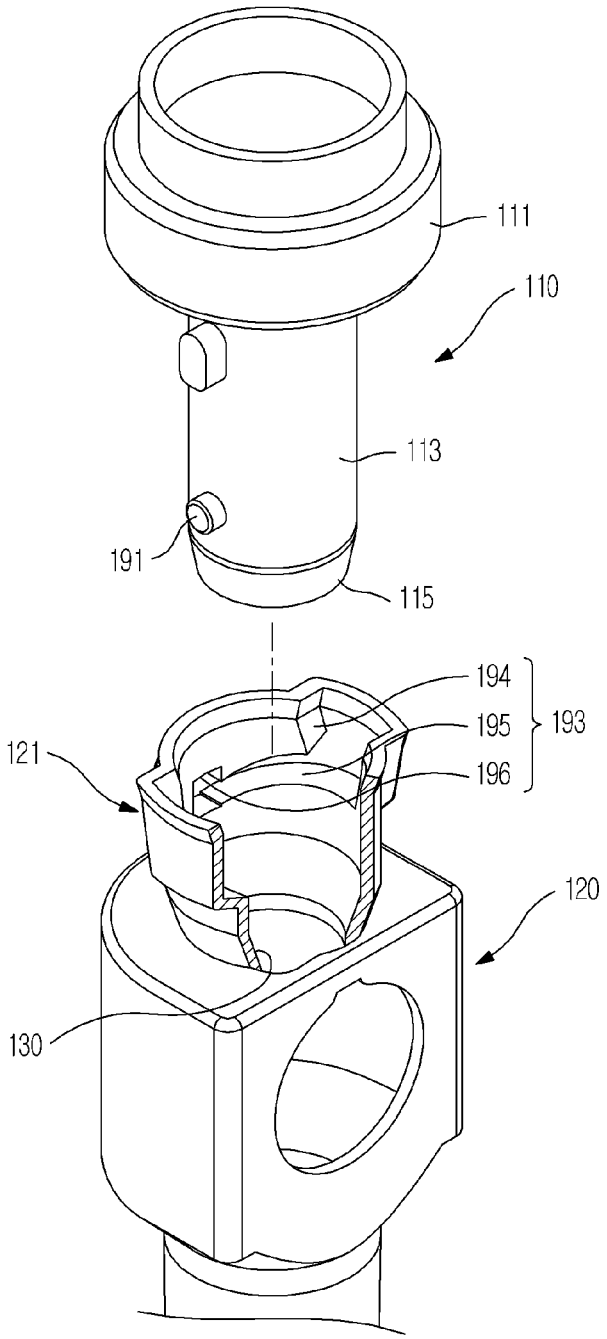
FIG. 5 is a perspective view illustrating a coupling relation of upper and lower hoses according to an exemplary embodiment of the present invention.
Figure 6:
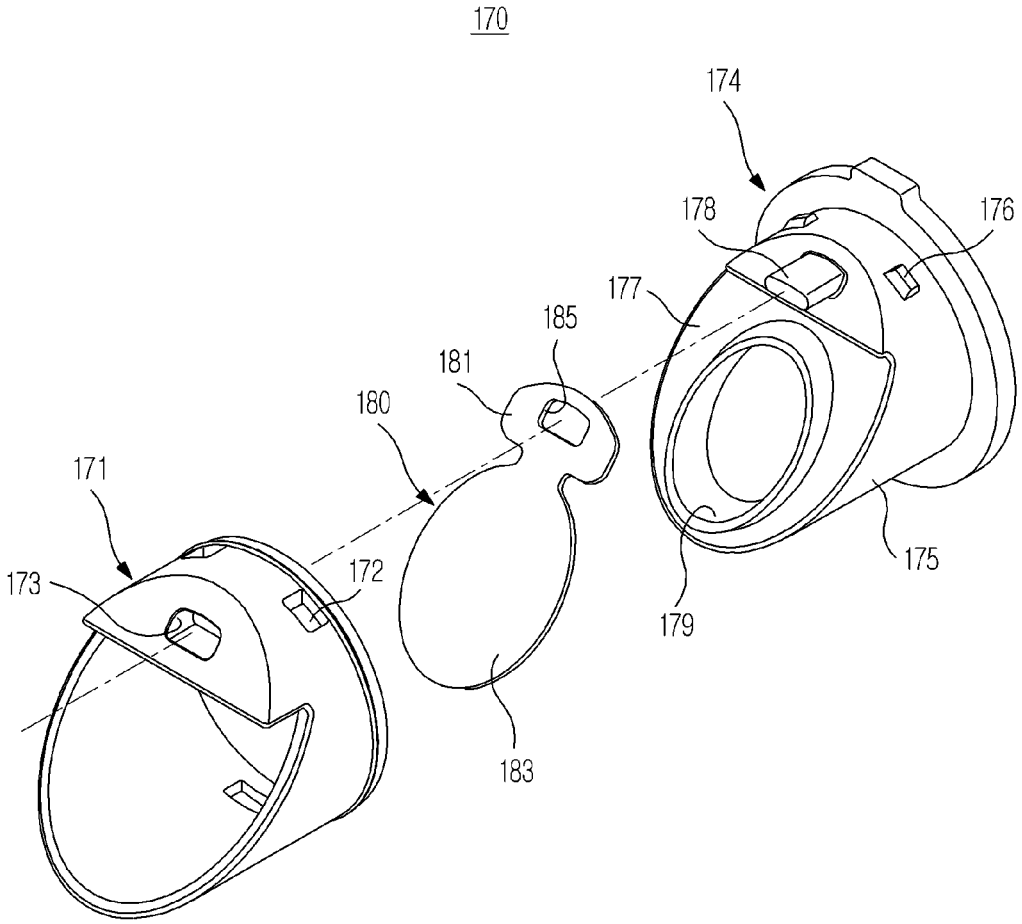
FIG. 6 is an exploded perspective view illustrating an opening and closing unit according to an exemplary embodiment of the present invention.
Figure 7:
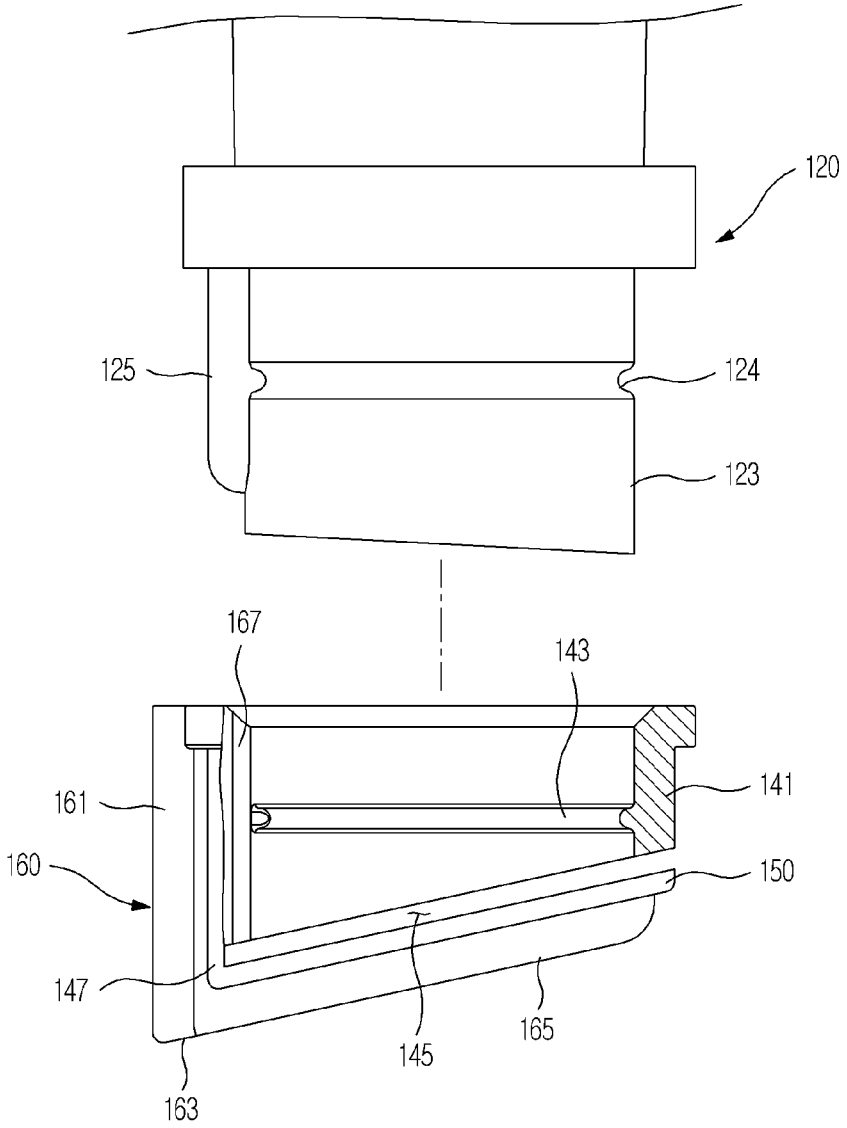
FIG. 7 is a view illustrating a coupling relation of one lower hose and a lower cap according to an exemplary embodiment of the present invention.

FIG. 3 is an exploded perspective view illustrating one drain hose assembly according to an exemplary embodiment of the present invention. FIG. 4 is a coupled sectional view corresponding to FIG. 3. FIG. 5 is a perspective view illustrating a coupling relation of the upper and lower hoses according to an exemplary embodiment of the present invention. FIG. 6 is an exploded perspective view illustrating an opening and closing unit according to an exemplary embodiment of the present invention. FIG. 7 is a view illustrating a coupling relation of one lower hose and a lower cap according to an exemplary embodiment of the present invention.

As shown in FIGS. 3 and 4, each drain hose assembly 100 may include one upper hose 110 connected to the corresponding defrost water tray 45, one lower hose 120 coupled to an end of the upper hose 110 while extending near an upper side of the evaporation tray 80 mounted in the machinery chamber 50, and one lower cap 140 coupled to an end of the lower hose 120 to prevent introduction of air into the lower hose 120 and to discharge defrost water.

Each drain hose assembly 100 may further include an opening and closing unit 170 to open and close an air inlet hole 179 into which outside air is introduced when negative pressure is generated in the storage chamber 20.

The upper hose 110 may include a cylindrical portion 111 having a hollow cylindrical shape and a plug portion 113 having a cylindrical shape. The cylindrical portion 111 may be coupled to the base plate 51 defining the machinery chamber 50. The plug portion 113 may have a relatively smaller diameter than the cylindrical portion 111 while extending from a lower portion of the cylindrical portion 111.

The lower hose 120 may have a vertically elongated hollow cylindrical shape. The lower hose 120 may include a socket portion 121 to be coupled to the upper hose 110 and a cylindrical lower hose plug portion 123 to be coupled to the lower cap 140. The socket portion 121 may be formed at an upper end of the lower hose 120, whereas the lower hose plug portion 123 may be formed at a lower end of the lower hose 120.

The upper and lower hoses 110 and 120 may be securely fastened to each other through a fastener 190, thereby having a simple connection structure.

The fastener 190 may include a pair of coupling protrusions 191 formed at opposite sides of an outer peripheral surface of the plug portion 113 in the upper hose 110, and coupling grooves 193 formed at an inner peripheral surface of the socket portion 121 in the lower hose 120 in order to be coupled with the corresponding coupling protrusions 191, respectively.

As shown in FIG. 5, the coupling grooves 193 may be formed to face each other. Each coupling groove 193 may include an entry portion 194 into which the corresponding coupling protrusion 191 is inserted, a spiral portion 195 formed beneath the entry portion 191 to be slanted downward in a spiral form so as to guide the coupling protrusion 191 in upward and downward directions, and a latch 196 to prevent separation of the coupling protrusion 191 from an end of the spiral portion 195.

In accordance with such a configuration, when the upper hose 110 is rotated in one direction after each coupling protrusion 191 is inserted into the corresponding entry portion 194, the coupling protrusion 191 moves downward while sliding along the corresponding downwardly slanted spiral portions 195, thereby inserting the plug portion 113 of the upper hose 110 into the socket portion 121 of the lower hose 120. Subsequently, when the upper hose 110 is further rotated in one direction, each coupling protrusion 191 is caught in the corresponding latch 196 so as to be supported by the latch 196. As a result, coupling between the upper and lower hoses 110 and 120 is maintained.

Meanwhile, when each coupling protrusion 191 is caught in the corresponding latch 196 so as to be supported by the latch 196, a lower end of the plug portion 113 of the upper hose 110 may be press-fitted into the socket portion 121 of the lower hose 120 at a position where the coupling protrusion 191 is supported by the latch 196 in a caught state. Consequently, sealing-tightness at a coupling region between the upper and lower hoses 110 and 120 may be increased.

To this end, the socket portion 121 may include a tapered portion 130 having a cylindrical shape at a lower side thereof, whereas the plug portion 113 of the upper hose 110 may include a press-fit portion 115 having a cylindrical shape at a lower side thereof. The tapered portion 130 may have a diameter reduced as going from an upper portion of the tapered portion 130 to a lower portion thereof, whereas the press-fit portion 115 may have a diameter reduced as going to an end thereof.

The press-fit portion 115 may have an outer diameter slightly smaller than an inner diameter of the tapered portion 130. Accordingly, when the upper and lower hoses 110 and 120 are fastened by interaction thereof through the fastener 190, an outer surface of the press-fit portion 115 comes into close contact with an inner surface of the tapered portion 130, thereby improving sealing-tightness there between.

In this case, since press-fit force between the press-fit portion 115 and the tapered portion 130 acts to force the upper hose 110 upward, each coupling protrusion 196 is caught in the latch 196 upwardly recessed from an end of the corresponding spiral portion 195 and supported. As a result, the upper and lower hoses 110 and 120 may be securely fastened.

A fastening method of the upper and lower hoses 110 and 120 may be simplified by the fastener 190. Accordingly, sealing-tightness between the upper and lower hoses 110 and 120 may be improved by a press-fit configuration between the upper and lower hoses 110 and 120 while shortening the time taken for connection of the upper and lower hoses 110 and 120.

The lower hose 120 may be provided, at an intermediate area thereof, with an opening and closing unit mounting portion 127 to mount the opening and closing unit 170. The opening and closing unit mounting portion 127 may be a through hole opened in order to press-fit the opening and closing unit 170 therein.

The opening and closing unit 170 which is mounted to the opening and closing unit mounting portion 127 may selectively introduce outside air.

As shown in FIG. 6, the opening and closing unit 170 may include an inner housing 171 fitted into the opening and closing unit mounting portion 127, an outer housing 174 coupled to the inner housing 171, and a barrier plate 180 interposed between the inner and outer housings 171 and 174.

The inner housing 171 may have a hollow cylindrical shape while being opened at opposite ends thereof to be press-fitted into the opening and closing unit mounting portion 127. A plurality of coupling holes 172 to couple the inner housing 171 to the outer housing 174 may be formed on an outer peripheral surface of the inner housing 171.

The outer housing 174 may include an insertion boss 175 to be inserted into the inner housing 171. The insertion boss 175 has a hollow cylindrical shape. The insertion boss 175 may be provided, on an outer peripheral surface thereof, with coupling ribs 176 corresponding to the coupling holes 172 of the inner housing 171.

A slanted mounting surface 177 may be formed at a rear end of the insertion boss 175. The slanted mounting surface 177 may be slanted downward as going from an upper portion of the slanted mounting surface 177 to a lower portion thereof. An air inlet hole 179 may be formed at the slanted mounting surface 177. The air inlet hole 179 may be communicated with the inside of the lower hose 120 so that outside air is introduced through the air inlet hole 179.

When the opening and closing unit 170 is mounted at the lower hose 120, the insertion boss 175 of the outer housing 174 passes through the opening and closing unit mounting portion 127 to protrude toward the inside of the lower hose 120, and the slanted mounting surface 177 is slantingly arranged with respect to a longitudinal direction of the lower hose 120.

The air inlet hole 179 may be opened and closed by the barrier plate 180 which is hinged to the slanted mounting surface 177. The barrier plate 180 may be made of an elastic material such as silicon or rubber, for example, and be mounted to close the air inlet hole 179 by gravity.

The barrier plate 180 may include a barrier plate hinge portion 181 and a shielding portion 183, which are integrated. The barrier plate hinge portion 181 may be inserted into a hinge protrusion 178 formed above the slanted mounting surface 177. The shielding portion 183 may extend from the barrier plate hinge portion 181 to have a shape corresponding to the air inlet hole 179, thereby closing the air inlet hole 179.

The barrier plate hinge portion 181 has a hinge insertion hole 185 which is inserted into the hinge protrusion 178. The hinge protrusion 178 passes through the hinge insertion hole 185 to be fitted into a hinge protrusion insertion hole 173 formed at the inner housing 171. Accordingly, the barrier plate hinge portion 181 is interposed between the outer and inner housings 174 and 171.

The barrier plate 180 mounted at the slanted mounting surface 177 operates as described below. The shielding portion 183 is upwardly pivoted about the barrier plate hinge portion 181 by negative pressure generated in the storage chamber 20 during opening of the door 30, thereby opening the air inlet hole 170. Subsequently, the shielding portion 183 is downwardly pivoted about the barrier plate hinge portion 181 by gravity after outside air is introduced through the opened air inlet hole 170, thereby closing the air inlet hole 170.

The barrier plate 180 has a structure designed to normally close the air inlet hole 179 by gravity. Consequently, outside air may be introduced toward the storage chamber 20 during opening of the door 30, while maintaining sealing-tightness to prevent high-temperature and high-humidity air generated in the machinery chamber 50 from being introduced into the storage chamber 20. Also, force required to open the door 30 may be reduced, so that a user may smoothly operate the door 30 during opening of the door 30.

Further, the barrier plate 180 is arranged to be slanted with respect to a longitudinal direction of the lower hose 120. Thus, defrost water falling from the upper hose 110 is dispersed by the barrier plate 180, thereby reducing noise due to dropping of the defrost water. In other words, even when the flow rate of defrost water is locally increased, the falling defrost water is dispersed by the barrier plate 180. The dispersed defrost water then flows downward along the inner peripheral surface of the lower hose 120, thereby preventing noise due to dropping of the defrost water.

Referring to FIGS. 3 and 7, the lower hose 120 may be provided, at the lower end thereof, with the lower hose plug portion 123 coupled to the lower cap 140. The lower hose plug portion 123, which has a hollow cylindrical shape, may have a relatively smaller diameter than the lower hose 120.

The lower cap 140 serves to close a lower opening of the lower hose 120 and to discharge the falling defrost water to the evaporation tray 80. The lower cap 140 may have a cylindrical body 141 made of an elastic material such as rubber or silicon, for example.

An upper portion of the body 141 may be opened to be inserted into the lower hose plug portion 123, and a lower portion of the body 141 may be provided with an elastic cover 150 to cover a lower opening of the lower hose plug portion 123.

The body 141 may have an inner diameter slightly smaller than an outer diameter of the lower hose plug portion 123. Accordingly, the lower hose plug portion 123 may be force-fitted into the body 141 so that the lower cap 140 is not easily separated from the lower hose 120, such as by vibration or impact, for example.

Further, the body 141 may be provided, on an inner peripheral surface thereof, with a sealing protrusion 143 formed along the inner peripheral surface of body 141 in order to improve sealing-tightness between the body 141 and the lower hose plug portion 123. The lower hose plug portion 123 may be provided with a sealing groove 124 formed to be recessed along an outer peripheral surface of the lower hose plug portion 123 to seat the sealing protrusion 143 therein.

The elastic cover 150 may be integrally formed with the body 141 made of an elastic material through formation of a slit 145 which is cut along a lower outer peripheral surface of the body 141.

A hinge portion 147 may be formed at one side of the slit 145 to be connected to the body 141. The elastic cover 150 may be pivoted about the hinge portion 147 in upward and downward directions.

The elastic cover 150 may be downwardly pivoted about the hinge portion 147 by the weight of defrost water to discharge defrost water, and be then pivoted upward by elastic force of the hinge portion 147 to close the lower opening of the lower hose 120.

Therefore, the slit 145 may be slanted upward as going from the hinge portion 147 in the opposite direction thereof, and the elastic cover 150 formed by the slit 145 may also be slanted upward so as to correspond to the slit 145.

Also, the lower cap 140 may further include an elastic rib 160 which protrudes and extends to connect the body 141, the hinge portion 147, and a base surface of the elastic cover 150, in order to increase elastic force to upwardly press the elastic cover 150.

The elastic rib 160 may include a vertical portion 161 which protrudes from an outer surface of the body 141 in a longitudinal direction of the body 141, a bent portion 163 bent from an end of the vertical portion 161 to enclose the hinge portion 147, and a slanted portion 165 extending from an end of the bent portion 163 to protrude from the base surface of the elastic cover 150.

The bent portion 163 provides elastic force to upwardly press the elastic cover 150, while supporting the elastic cover 150 so as to allow the elastic cover 150 to be elastically opened by reinforcing the elastic force of the hinge portion 147.

A rib insertion groove 167 extending vertically is formed at an inner side of vertical portion 161 of the elastic rib 160, whereas a vertical rib 125 protrudes from the outer peripheral surface of the lower hose plug portion 123 and extends in a vertical direction. The rib insertion groove 167 is coupled to the vertical rib 125. Such a configuration increases the contact area between the body 141 and the lower hose plug portion 123, thereby enhancing the coupling force there between. As a result, sealing-tightness between the body 141 and the lower hose plug portion 123 may be increased.

Figure 8:
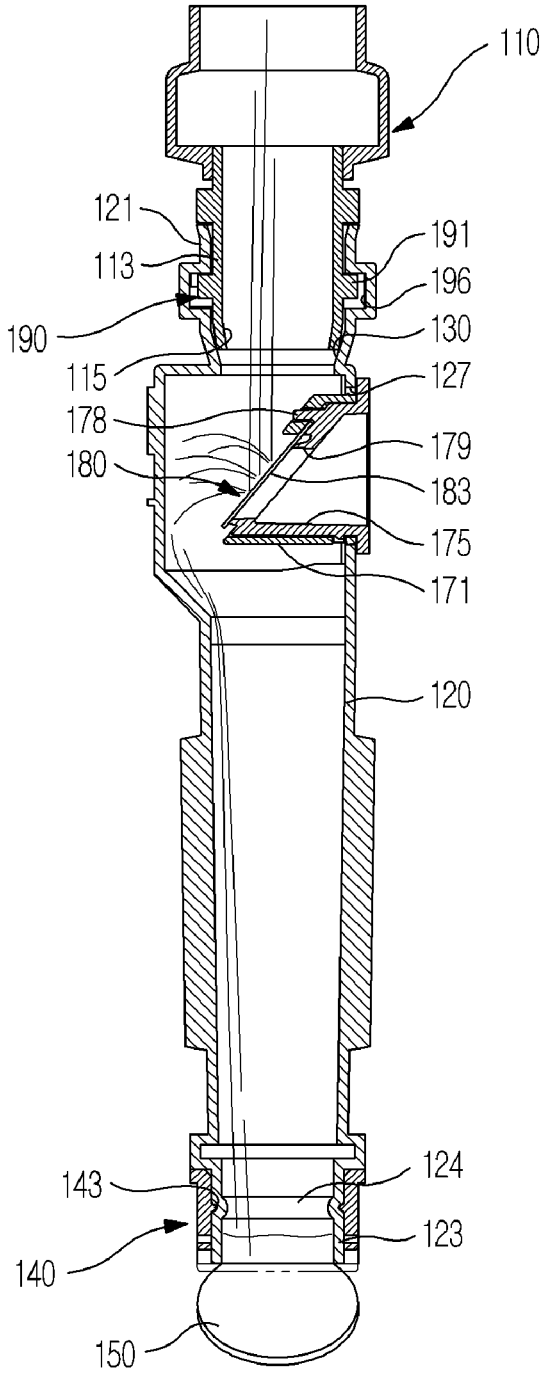
FIG. 8 is a view illustrating drainage operation of one drain hose assembly according to an exemplary embodiment of the present invention.
Figure 9:
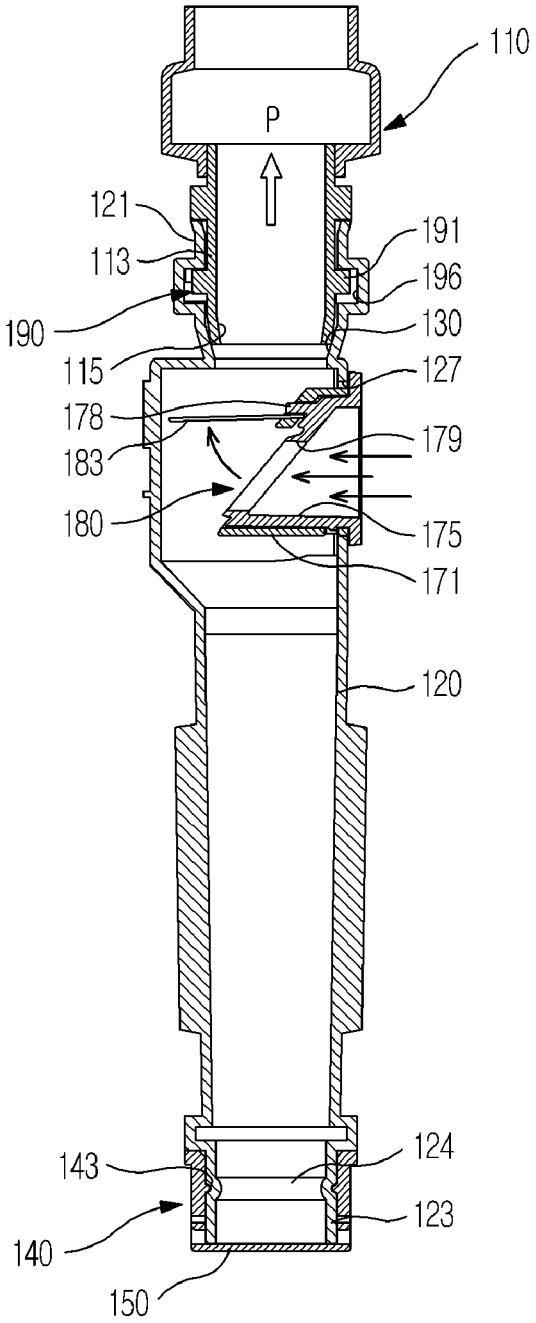
FIG. 9 is a view illustrating opening and closing operation of one drain hose assembly according to an exemplary embodiment of the present invention.

Hereinafter, operation of the drain hose assembly according to an exemplary embodiment of the present invention will be described. FIG. 8 is a view illustrating drainage operation of one drain hose assembly according to an exemplary embodiment of the present invention. FIG. 9 is a view illustrating opening and closing operation of one drain hose assembly according to an exemplary embodiment of the present invention.

First, defrost water generated during a defrost process of the evaporator 40 is collected in each defrost water tray 45 arranged at the lower portion of the corresponding refrigerating or freezing chamber evaporator 41 or 43 in the evaporator 40. Subsequently, the defrost water collected in the defrost water tray 45 is discharged toward the evaporation tray 80 mounted in the machinery chamber 50 through the corresponding drain hose assembly 100. Thereafter, the defrost water collected in the evaporation tray 80 is evaporated using heat which is generated from the condenser 70 and air movement generated from the fan 90 installed in the machinery chamber 50.

In this case, the defrost water, which falls from the defrost water tray 45 to the drain hose assembly 100, is dispersed by the barrier plate 180 mounted at the slanted mounting surface 177 protruding toward the inside of the lower hose 120. Consequently, the dispersed defrost water flows downward along the inner peripheral surface of the lower hose 120, thereby reducing noise due to defrost water which would otherwise directly fall to the elastic cover 150 of the lower cap 140.

The elastic cover 150 is downwardly pivoted about the hinge portion 147 by the weight of defrost water flowing toward the elastic cover 150 of the lower cap 140, thereby discharging the defrost water to the evaporation tray 80. Subsequently, the elastic cover 150 is upwardly pivoted by elastic restoring force again, thereby closing the lower opening of the lower hose 120.

Accordingly, in each drain hose assembly 100 according to an exemplary embodiment, both the lower opening of the lower hose 120 communicated with the outside and the air inlet hole 179 into which outside air is introduced are maintained in a closed state by the lower cap 140 and the opening and closing unit 170, respectively. Consequently, it may be possible to prevent high-temperature and high-humidity air generated in the machinery chamber 50 from being introduced into the storage chamber 20. Accordingly, it may be possible to prevent a loss of energy due to deterioration in cooling efficiency resulting from a state in which high-temperature and high-humidity air is introduced into the evaporator 40 through the drain hose assembly 100.

Also, high-temperature air introduced toward the evaporator 40 causes temperature variation around the evaporator 40. This causes a slip phenomenon due to a difference in the coefficient of thermal expansion between the inner case 12 adjacent to the evaporator 40 and the insulating material, thereby resulting in deformation of the inner case 12 and generating noise due to the deformation of the inner case 12. However, the drain hose assembly 100 having an improved sealing structure may noticeably reduce the generation of noise.

Meanwhile, the air inlet hole 179 through which outside air is introduced into the storage chamber 20 is normally maintained in a closed state by the barrier plate 180 of the opening and closing unit 170. That is, the air inlet hole 179 formed at the slanted mounting surface 177 comes into close contact with the barrier plate 180 made of an elastic material by gravity. As a result, generation of a clearance between the air inlet hole 179 and the barrier plate 180 may be decreased, thereby maintaining sealing-tightness in a greatly improved state.

When a user opens the door 30 of the refrigerator, the barrier plate 180 is upwardly pivoted by negative pressure generated in the storage chamber 20, thereby opening the air inlet hole 179. Subsequently, outside air is introduced into the storage chamber 20 through the air inlet hole 179. Therefore, the force required to open the door 30 may be reduced, so that a user may smoothly open the door 30.

After the door 30 is opened, the barrier plate 180 is downwardly pivoted by gravity again to close the air inlet hole 179, thereby preventing introduction of outside air.

As is apparent from the above description, a refrigerator including a drain hose assembly according to an exemplary embodiment of the present invention may achieve an improvement in energy efficiency by reducing introduction of outside air into a storage chamber side.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body to define a storage chamber;

a door mounted at the main body to open and close the storage chamber;

an evaporator to cool the storage chamber;

an inner case to define the storage chamber, the inner case including an evaporator receiving portion at which the evaporator is installed and a defrost water tray slantingly arranged at a lower side of the evaporator receiving portion;

a machinery chamber provided at a lower portion of the main body to receive an evaporation tray;

an upper hose communicated with the defrost water tray;

a lower hose connected to the upper hose while extending to the evaporation tray, the lower hose being provided, at one side thereof, with an air inlet hole to introduce outside air, wherein the air inlet hole is formed at a slanted mounting surface protruding inside of a vertically-extending portion of the lower hose while being slanted downward;

a lower cap coupled to a lower end of the lower hose while having an elastic cover to prevent air from being introduced into the lower hose; and an opening and closing unit provided in the vertically-extending portion of the lower hose, the opening and closing unit being configured to open the air inlet hole by an internal pressure of the storage chamber during opening of the door, and to close the air inlet hole by gravity.

2. The refrigerator according to claim 1, wherein the opening and closing unit comprises a barrier plate hinged to the slanted mounting surface.

3. The refrigerator according to claim 1, further comprising:

a fastener to fasten the upper hose and the lower hose through spiral rotation of the fastener, wherein when being fastened by the fastener, the upper and lower hoses are coupled in a press-fitted manner.

4. The refrigerator according to claim 3, wherein:

the fastener comprises a coupling protrusion protruding from an outer peripheral surface of the upper hose, and a coupling groove formed at an inner peripheral surface of the lower hose so as to be coupled to the coupling protrusion; and the coupling groove comprises an entry portion into which the coupling protrusion is inserted, a spiral portion arranged beneath the entry portion to guide the coupling protrusion in upward and downward directions, and a latch arranged at a lower end of the spiral portion to prevent separation of the coupling protrusion.

5. The refrigerator according to claim 4, wherein a tapered portion, into which an end of the upper hose is press-fitted, is provided beneath the coupling groove.

6. The refrigerator according to claim 1, wherein the lower cap comprises a body, which is made of an elastic material and has a cylindrical shape, press-fitted into the lower hose, and the elastic cover is integrally formed with the body through a slit cut along an outer peripheral portion of the body to close a lower opening of the lower hose.

7. The refrigerator according to claim 6, wherein the slit is formed to be slanted upward as going from a hinge portion for connection of the elastic cover and the body in an opposite direction of the hinge portion.

8. The refrigerator according to claim 6, wherein the lower cap further comprises a sealing protrusion formed to protrude along an inner peripheral surface of the body.

9. The refrigerator according to claim 7, wherein the lower cap further comprises an elastic rib formed to connect the body, hinge portion, and elastic cover, in order to provide elastic force to upwardly press the elastic cover.

10. The refrigerator according to claim 1, wherein the opening and closing unit comprises an inner housing coupled to the air inlet hole, an outer housing coupled to the inner housing while having the air inlet hole to be communicated with an inside of the lower hose, and a barrier plate interposed between the inner and outer housings to open and close the air inlet hole.

11. The refrigerator according to claim 10, wherein the outer housing further has a slanted mounting surface having a hinge protrusion which protrudes from a back surface of the outer housing to the inside of the lower hose, the barrier plate being pivotally coupled to the hinge protrusion.

12. The refrigerator according to claim 11, wherein the barrier plate comprises a barrier plate hinge portion coupled to the hinge protrusion, and a shielding portion formed to extend from the barrier plate hinge portion to open and close the air inlet hole.

13. A drain hose assembly including a storage chamber, a door to open and close the storage chamber, and an evaporator installed at a rear side of the storage chamber, so as to discharge defrost water generated on the evaporator, comprising:

an upper hose and a lower hose coupled to each other;

a lower cap coupled to a lower end of the lower hose to discharge defrost water;

an air inlet hole provided at one side of the lower hose to introduce outside air, wherein the air inlet hole is formed at a slanted mounting surface protruding inside of a vertically-extending portion of the lower hose while being slanted downward; and an opening and closing unit formed in the vertically-extending portion of the lower hose to open and close the air inlet hole, the opening and closing unit configured to be upwardly pivoted by an internal pressure of the storage chamber during opening of the door in order to open the air inlet hole, and to be downwardly pivoted by gravity in order to close the air inlet hole.

14. The drain hose assembly according to claim 13, wherein the opening and closing unit comprises a barrier plate, which is made of an elastic material, hinged to the slanted mounting surface.

15. The drain hose assembly according to claim 13, further comprising:

a fastener to fasten the upper hose and the lower hose through spiral rotation of the fastener, wherein when the upper and lower hoses are coupled by the fastener, an outer peripheral surface of the upper hose is press-fitted to an inner peripheral surface of the lower hose so that contact surfaces of the upper and lower hoses are sealed.

16. The drain hose assembly according to claim 15, wherein each of the contact surfaces of the upper and lower hoses has a tapered shape having a diameter reduced as going downward.

17. The drain hose assembly according to claim 15, wherein:

the fastener comprises a coupling protrusion protruding from the outer peripheral surface of the upper hose, and a coupling groove formed at the inner peripheral surface of the lower hose so as to allow the coupling protrusion to be inserted into the coupling groove; and the coupling groove comprises an entry portion into which the coupling protrusion is inserted, a spiral portion to guide the coupling protrusion in upward and downward directions, and a latch formed at a lower end of the spiral portion to prevent separation of the coupling protrusion.

18. The drain hose assembly according to claim 13, wherein the lower cap comprises an elastic cover to close a lower opening of the lower hose by elasticity and to open the lower opening of the lower hose by being downwardly pivoted by a weight of defrost water.

19. A refrigerator including a drain hose assembly to discharge defrost water generated on an evaporator installed at a rear side of a storage chamber, wherein the drain hose assembly comprises, an upper hose and a lower hose coupled to each other;

a lower cap coupled to a lower end of the lower hose to close a lower opening of the lower hose and to be pivoted by a weight of defrost water so as to discharge defrost water;

an air inlet hole provided at one side of the lower hose to introduce outside air, wherein the air inlet hole is formed at a slanted mounting surface protruding inside of a vertically-extending portion of the lower hose while being slanted downward; and an opening and closing unit formed in the vertically-extending portion of the lower hose to open and close the air inlet hole, the opening and closing unit configured to be upwardly pivoted by a negative pressure in the storage chamber to open the air inlet hole, and to be downwardly pivoted by gravity to close the air inlet hole, and wherein the upper and lower hoses have contact surfaces so as to be press-fitted to each other, respectively, each of the contact surfaces being comprised of a tapered shape having a diameter reduced as going downward.

* * * * *